US008826709B2

(12) United States Patent
Dehaven et al.

(10) Patent No.: US 8,826,709 B2
(45) Date of Patent: Sep. 9, 2014

(54) RELOCKING MECHANISM

(75) Inventors: Greg Dehaven, Lexington, KY (US); Kenneth H. Mimlitch, Lexington, KY (US); Edward Pollard, Danville, KY (US)

(73) Assignee: Kaba Mas, LLC, Lexington, KY (US)

( * ) Notice: Subject to any disclaimer, the term of this patent is extended or adjusted under 35 U.S.C. 154(b) by 1 day.

(21) Appl. No.: 13/639,970

(22) PCT Filed: Oct. 21, 2010

(86) PCT No.: PCT/US2010/053516

§ 371 (c)(1), (2), (4) Date: Oct. 8, 2012

(87) PCT Pub. No.: WO2011/126514

PCT Pub. Date: Oct. 13, 2011

(65) Prior Publication Data

US 2013/0042657 A1 Feb. 21, 2013

Related U.S. Application Data

(60) Provisional application No. 61/322,484, filed on Apr. 9, 2010.

(51) Int. Cl.

| | |
|---|---|
| ***E05B 47/00*** | (2006.01) |
| ***E05C 3/06*** | (2006.01) |
| ***E05B 17/00*** | (2006.01) |
| ***E05B 17/20*** | (2006.01) |
| *E05B 65/00* | (2006.01) |
| *E05B 47/06* | (2006.01) |

(52) U.S. Cl.

CPC ..... *E05B 17/2092* (2013.01); *E05B 65/0082* (2013.01); *E05B 47/0603* (2013.01); *E05B 17/0062* (2013.01); *E05B 47/0012* (2013.01)

USPC ..... 70/416; 70/333 R; 70/422

(58) Field of Classification Search

USPC ..... 70/1.5, 1.7, 84, 210, 321, 333 R, 416, 70/422; 109/59 R, 59 T

See application file for complete search history.

(56) References Cited

U.S. PATENT DOCUMENTS

| | | | |
|---|---|---|---|
| 2,228,971 | A | 1/1941 | Pankratz |
| 4,143,528 | A | 3/1979 | Weber et al. |

(Continued)

OTHER PUBLICATIONS

International Search Report; International Application No. PCT/US2010/053516; International Application Filing Date Oct. 21, 2012; Mail Date Dec. 17, 2010.

(Continued)

*Primary Examiner* — Christopher Boswell

(74) *Attorney, Agent, or Firm* — Cantor Colburn LLP

(57) ABSTRACT

A relocking mechanism that blocks the path of a bolt within a lock assembly is presented. The relocking mechanism comprises a breakaway member that is repositioned when the lock assembly is attacked by some mechanical means, such as impact applied via a hammer and punch to the lock housing through a spindle hole in a door. The breakaway member prior to attack holds a preloaded relocking plunger clear from bolt movement. When the breakaway member is repositioned upon attack, the plunger is free to move under a biasing force into position so as to block the bolt thus keeping the lock in a secure locked state regardless of the state of the locks default blocking mechanism.

20 Claims, 7 Drawing Sheets

(56) References Cited

U.S. PATENT DOCUMENTS

| | | | | |
|---|---|---|---|---|
| 5,142,890 | A * | 9/1992 | Uyeda et al. | 70/277 |
| 5,473,922 | A | 12/1995 | Bair et al. | |
| 5,491,992 | A | 2/1996 | Mandall | |
| 5,592,838 | A | 1/1997 | Clark et al. | |
| 6,679,087 | B2 * | 1/2004 | Suggs et al. | 70/153 |
| 6,786,519 | B2 | 9/2004 | Gartner | |
| 6,910,357 | B2 | 6/2005 | Hirvi | |
| 7,461,872 | B2 * | 12/2008 | Moon et al. | 292/209 |
| 7,770,944 | B2 * | 8/2010 | Yuan | 292/195 |
| 8,083,273 | B2 * | 12/2011 | Yuan | 292/201 |
| 8,261,586 | B2 * | 9/2012 | Gartner | 70/277 |

OTHER PUBLICATIONS

Written Opinion; International Application No. PCT/US2010/053516; International Application Filing Date Oct. 21, 2012; Mail Date Dec. 17, 2010.

* cited by examiner

RELOCKING MECHANISM

TECHNICAL FIELD

The application relates generally to locks and, more particularly, to a relocking mechanism for blocking a bolt of a lock from being displaced to its unlocking position in the event of certain types of physical attacks, such as hammering and punching.

BACKGROUND OF THE ART

Locks can be physically attacked in many ways, including hammering, punching and drilling. It is desired that a lock not merely physically resist such attacks, but also respond appropriately to the attacks by ensuring that the bolt of the lock cannot be moved to its unlocking position during or after the attack.

SUMMARY

Therefore, it is an aim of the present application to provide a new relocking mechanism for automatically relocking a lock when the lock is physically attacked.

In one aspect, there is thus provided a relocking mechanism which is triggered by impact forces transmitted to the lock case assembly, the mechanism comprising a relocking member movable under the impact forces to an operational position in which the lock bolt is physically blocked against movement to an unlocking position thereof.

In another aspect, there is provided a relocking mechanism for a lock assembly having a bolt movable between a locking position and an unlocking position, the relocking mechanism comprising a breakaway or displaceable member holding a pre-loaded plunger from blocking a bolt until a mechanical attack through a spindle hole in a door to which the lock is mounted causes the breakaway or displaceable member to release the plunger to its functional position in which the plunger blocks the bolt from moving to its unlocking position.

The release of the plunger automatically physically blocks the extended bolt so as to prevent externally-applied force from thrusting the bolt back into the lock case. The plunger may be spring-loaded or otherwise biased towards its extended operational position.

According to another general aspect, there is provided a swing bolt lock comprising a swing bolt rotatable between locking and unlocking positions, a blocking member for selectively preventing rotation of the swing bolt, and a relocking mechanism engageable with one of said swing bolt and said blocking member to block said swing bolt from rotating to said unlocking position thereof when the lock is subject to a physical attack.

According to another general aspect, there is provided a relocking mechanism for automatically locking a lock in a secure locked state when subject to a physical attack, the lock having a housing mounted to a door defining a spindle hole, the lock having a bolt moveable between a locking and an unlocking position; the relocking mechanism comprising: a plunger normally held in a retracted position by a breakaway member disposed to receive the force of an impact attack through the spindle hole of the door, the force of the impact attack causing the breakaway member to release the plunger which is then free to move under the action of a biasing member to an extended position in which the plunger physically blocks the movement of the bolt to the unlocking position.

According to a still further general aspect, there is provided a swing bolt lock comprising a swing bolt mounted in a housing adapted to be mounted to a door having a spindle hole defined therethrough, the swing bolt being pivotable between a locking and an unlocking position, a blocker movably mounted in said housing towards and away from the swing bolt for selectively blocking or allowing rotation of the swing bolt during normal operation, and a relocking mechanism for automatically locking the swing bolt in a secure locked state when the lock is subject to a physical attack, the relocking mechanism comprising a first member connected in force transmission relationship to the housing such that externally-applied forces against the housing through the spindle hole of the door are transmitted to the first member, and a second member having an abutting surface for engagement with the swing bolt, the abutting surface of the second member physically blocking the swing bolt from moving to the unlocking position when the first member is moved from an initial default position to an operational position under the externally-applied forces.

DESCRIPTION OF THE DRAWINGS

Reference is now made to the accompanying figures, in which.

DETAILED DESCRIPTION

Figure 1:
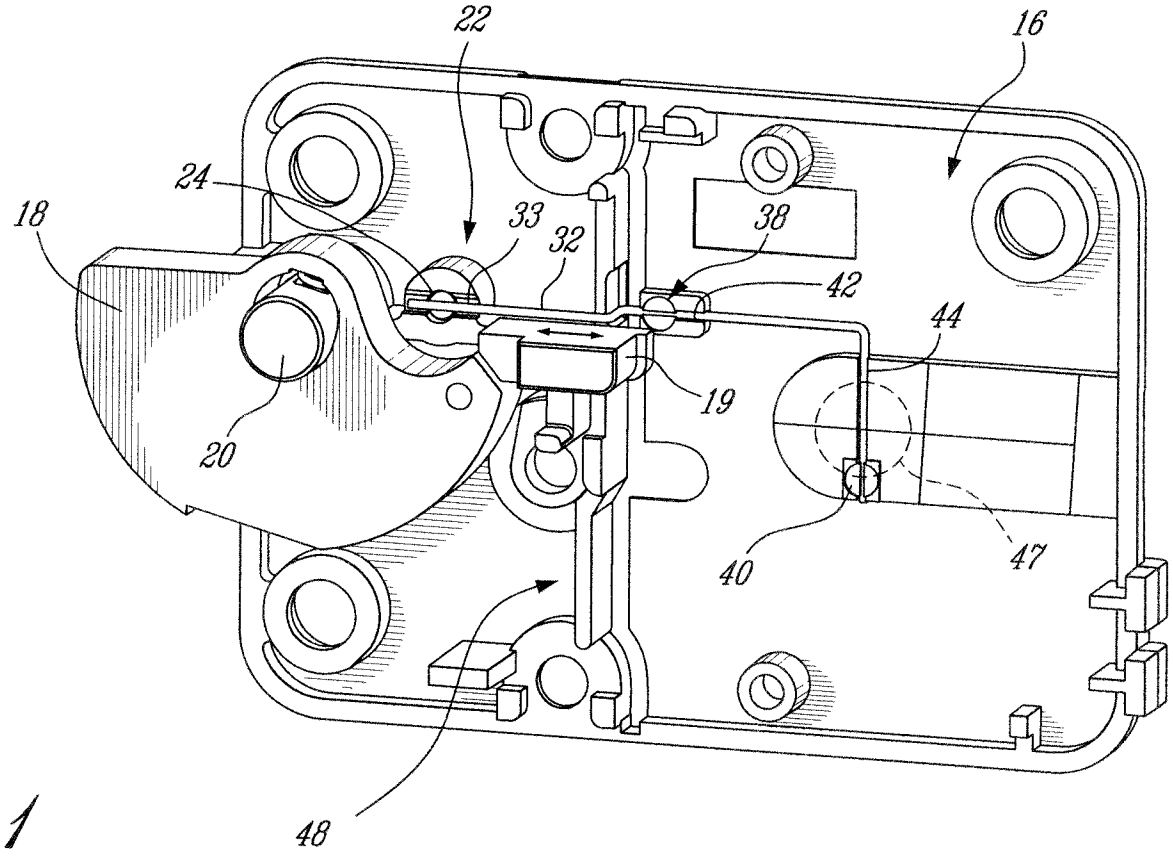
FIG. 1 is a side view illustrating internal components of a so-called swing or rotary bolt lock assembly mounted on the inner face of a lock cover of the lock housing, the internal components including among others a bolt and a relocking mechanism for automatically blocking movement of the bolt in the event of a physical attack against the lock.

FIGS. 1 to 4 illustrate a relocking mechanism 22 for holding a locking assembly 10 in a secure locking state in the event of a physical attack. As shown in the Figures, the relocking mechanism 22 can be incorporated in a so-called swing bolt lock assembly 10 having a swing bolt 18 mounted for pivotal movement between locking and unlocking positions. It is however understood that the relocking mechanism 22 could be adapted and integrated to other types of lock, including locks having linearly reciprocable bolts (e.g. a deadbolt).

The lock assembly 10 is adapted to be mounted to a safe door (not shown) of a safe (not shown). However, it is understood that the lock assembly could be mounted to other types of closure. As will be seen hereinafter, the relocking mechanism 22 is particularly designed to resist physical attacks with a hammer and metal rod or punch through a spindle hole defined in the safe door for receiving a dial spindle and/or electronic wires required to input combination from a front input unit (not shown) to the lock case assembly 10.

The lock assembly 10 comprises a housing 12 including a lock case 14 (FIGS. 3 and 4) and a lock cover 16 adapted to be assembled together to define an enclosure for housing the internal components of the lock assembly 10. It is noted that the lock assembly 10 can be installed with either the lock cover 16 or the lock case 14 mounted against the inner surface of the safe door. Accordingly, the relocking mechanism 22 can be designed to resist external forces transmitted to both the lock cover 16 and the lock case 14 (i.e. the relocking mechanism 22 can be operational irrespectively of the mounting orientation of the lock on the safe door).

The bolt 18 of the lock assembly 10 projects outwardly from a front end of the housing 12 and is mounted on an axle 20 for pivotal movement between locking and unlocking positions. A motor or other actuation device (not shown) powered by battery or any other source of power may be mounted in the housing 12 to actuate a reciprocable blocking member 19 to selectively allow the bolt 18 to rotate between its locking and unlocking positions, as is well known in the art. The various lock components limiting the swing bolt 18 between its locking and unlocking positions are not material to the operation of the relocking mechanism 22 and will thus not be herein described.

Figure 3:
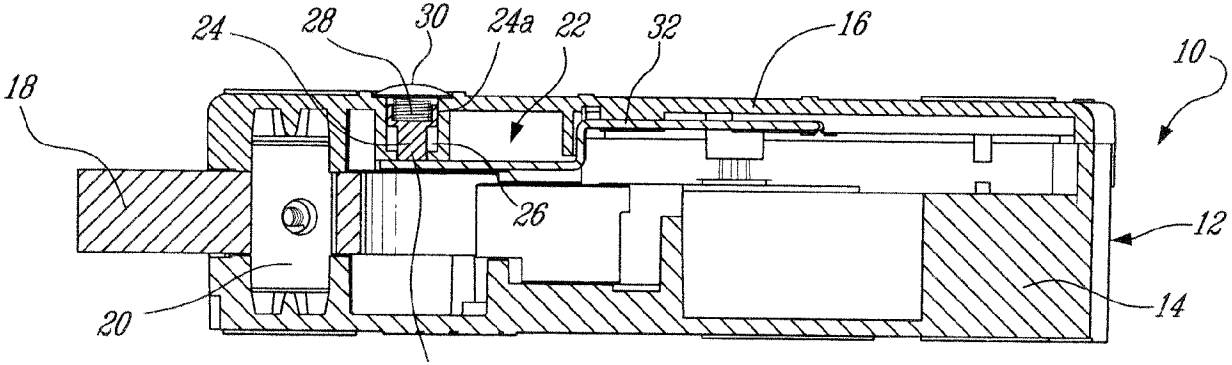
FIG. 3 is a top cross-section of the lock assembly illustrating the relocking mechanism in a retracted non-operational default state.
Figure 4:
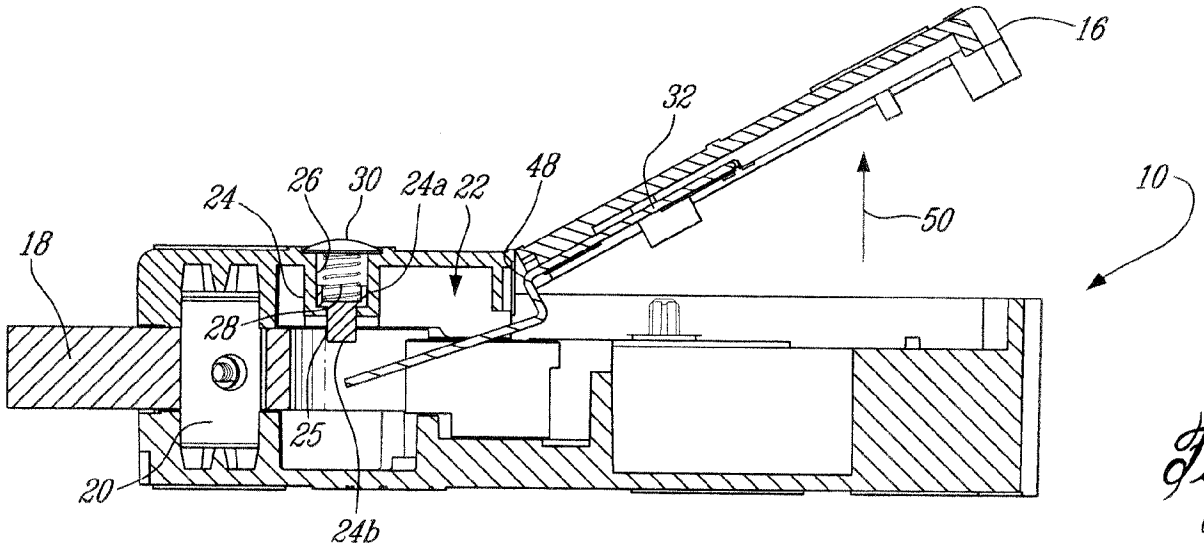
FIG. 4 is a top cross-section of the lock assembly after a physical attack and illustrating the relocking mechanism in its operational position to physically block the bolt from pivoting to its unlocking position, thereby holding the lock assembly in its secure locked state.

The relocking mechanism 22 generally comprises first and second members for respectively receiving the impact forces and blocking the bolt. As best shown in FIGS. 3 and 4, the second member may comprise a plunger 24 slidably mounted in a recess 26 defined in the external face of the lock cover 16. An opening 25 is defined in the bottom surface of the recess 26 to allow the plunger 24 to project into the internal volume of the housing 12. The plunger 24 has a head portion 24*a* and a shaft portion 24*b*. The head portion 24*a* is in sliding contact with the wall of the recess 26 and the shaft portion 24*b* is engaged in the opening 25. A biasing member 28, a compression spring in the illustrated embodiment, axially urges the plunger 24 towards an extended position (FIG. 4) in which the plunger 24 projects inside the housing 12. It is understood that the biasing member 28 could take various forms including but not limited to a leaf spring, a tension spring, magnets etc. According to the illustrated embodiment, the biasing member 28 is received at one end thereof in a recess defined in the head portion 24*a* of the plunger 24. The other end of the biasing member 28 rests against the inner face of a cap 30 securely mounted to the external face of the rear cover 16 to close the recess 26 once the plunger 24 and the biasing member 28 have been loaded therein.

The first member of the relocking mechanism 22 may comprise a breakaway or pull-away member 32 normally engaged with the plunger 24 to hold the same in a retracted non-functional default position (FIGS. 1 and 3) against the biasing force of the biasing member 28. In this retracted position, the plunger 24 clears the path of the bolt 18, thereby allowing for normal operation of the bolt 18 between its locking and unlocking positions.

As best shown in FIG. 1, the breakaway member 32 can, for instance, take the form of a deformable metal wire form mounted to the internal face of the lock cover 16. The term "breakaway member" is herein intended to generally refer to any types of member that could be used to normally hold the plunger 24 and automatically release it when subject to a direct or indirect impact force, as will be seen hereinafter. The breakaway member 32 is positioned on the internal face of the lock cover 16 such that a distal end portion thereof extends through an open-ended horizontal slot 33 intersecting the opening 25 receiving the shaft portion 24*b* of the plunger 24. The horizontal slot 33 acts as a localization aid to ensure proper positioning of the breakaway member 32 relative to the plunger 24 (i.e. it ensures that the breakaway member 32 extends across the path of the plunger 24).

As shown in FIGS. 1 and 3, the plunger 24 can thus be preloaded against the breakaway member 32 with the biasing member 28 urging the tip of the plunger 24 against the breakaway member 32. In other words, the breakaway member 32 extends on the internal face of the lock cover 16 directly in front of the plunger 24 to normally hold the same in its retracted position against the biasing force of the biasing member 28, thereby providing for the normal operation of the bolt 18 by the driving components of the lock assembly 10.

Figure 2:
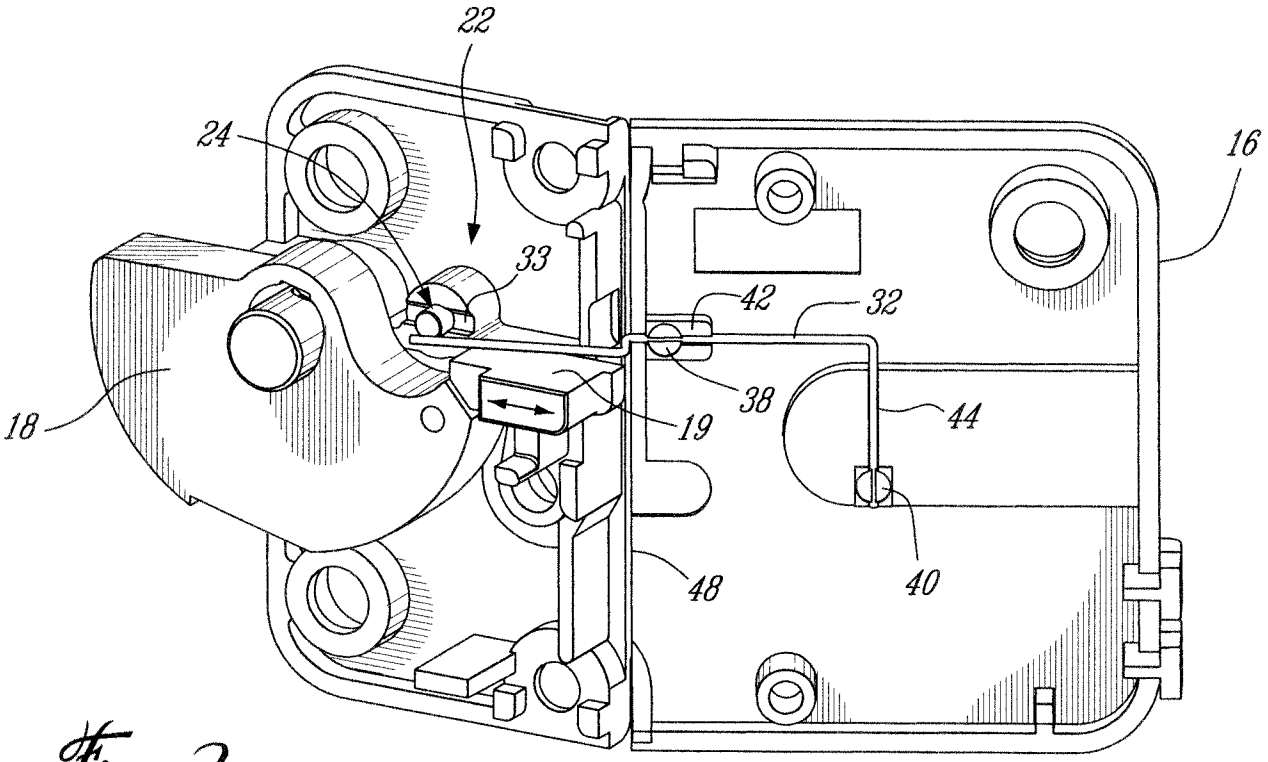
FIG. 2 is a side view of the lock cover after a physical attack, the plunger of the relocking mechanism being biased to an operational position in which the plunger extends into the path of the bolt to maintain the lock in a secure locked state.

As shown in FIGS. 1 and 2, the breakaway member 32 has first and second spaced-apart points of attachment 38 and 40 to the lock cover 16. The breakaway member 32 can be riveted, soldered or otherwise connected in force transmission relationship to the lock cover 16. The first point of attachment 38 is provided on a horizontal segment of the breakaway member 32 at a location spaced-apart from the plunger 24. The second point of attachment 40 is provided on a vertical segment of the breakaway member 32 at one end thereof opposite the plunger 24. The horizontal and vertical segments of the breakaway member 32 are respectively received in horizontal and vertical localization slots 42 and 44 defined in wire holding portions projecting inwardly from the internal face of the lock cover 16 and configured for accommodating the first and second points of attachment 38 and 40, thereby not only ensuring proper positioning of the breakaway member 32 relative to the plunger 24 but also relative to the potential points of attack of the lock assembly 10, as will be seen hereinafter.

One potential point of attack on the lock assembly 10 is the spindle hole defined in the safe door. The relative location of the spindle hole when the lock assembly 10 is mounted to a door is depicted by circled area 47 in FIG. 1. It can be appreciated from FIG. 1, that the breakaway member 32 is generally aligned with this potential zone of attack. Indeed, the vertical segment of the breakaway member 32 extends substantially centrally across the circled area 47. The potential zone of attack provided by the spindle hole is disposed between the first and second points of attachment 38 and 40 of the breakaway member 32. In fact, the second point of attachment 40 can be located immediately next or in the zone of attack identified by circled area 47 in FIG. 1.

As shown in FIGS. 1 and 2, the lock cover 16 has a thinned or weak cover section 48 provided between the plunger 24 and the first and second points of attachments 38 and 40. The first and second point of attachments 38 and 40 of the breakaway member 32 are both located on the same side of the thinned or weak cover section 48 (the right-hand side in FIG. 1), that is on a side opposite to the side on which the plunger 24 is disposed. It is also noted that the first and second points of attachment 38 and 40 and the identified potential zone of attack (i.e. circled area 47 in FIG. 1) are disposed on the same side of the lock cover 16 relative to the thinned cover section 48. As shown in FIGS. 2 and 4, the lock cover 16 is designed to break along the thinned or weak cover section 48 when an impact force exceeding a predetermined threshold value is transmitted to or is directly applied on the inside of the lock cover 16. Accordingly, if the lock assembly 10 is mounted to the internal side of a door with the lock case 14 against the internal face of the door and if the lock assembly 10 is physically attacked with a hammer and metal rod or punch through the spindle hole in the safe door, the lock cover 16 will break along the thinned cover section 48, thereby allowing the portion of the lock cover 16 which receive the impact force (the right-hand side portion in FIG. 4) to move out of position, as depicted by arrow 50 in FIG. 4. Since the points of attachment 38 and 40 of the breakaway member 32 are all provided on the broken portion of the lock cover 16, the breakaway member 32 will move jointly with the broken portion of the lock cover 16, thereby causing the free distal end portion of the breakaway member 32 to pivot or move away from the plunger 24, as best seen in FIG. 4. This allows the plunger 24 to move to its extended position under the biasing force of the biasing member 26. As can be appreciated from FIGS. 2 and 4, in its extended position, the plunger 24 physically blocks the bolt 18 from being rotated in a counter clockwise direction towards its unlocking position.

If the lock assembly 10 is mounted with the lock cover 16 against the door, the alignment of the breakaway member 32 with the spindle hole between the two points of attachment 38 and 40 will cause the breakaway member 32 to be ripped out of the lock cover 16 under the direct impact of the punch, thereby automatically releasing the plunger 24 to block the bolt 18 against movement as detailed hereinabove.

In view of the foregoing, it is apparent that the above described relocking mechanism 22 has a reversible design providing for the mounting of the lock assembly 10 with either the lock case 14 or the lock cover 16 against the door. If the lock assembly 10 is only intended to be mounted on the door with the lock case 14 against the door, the breakaway member 32 could only include the horizontal segment (i.e. in this case there is no need for the breakaway member to be aligned with the zone of impact).

Figure 5:
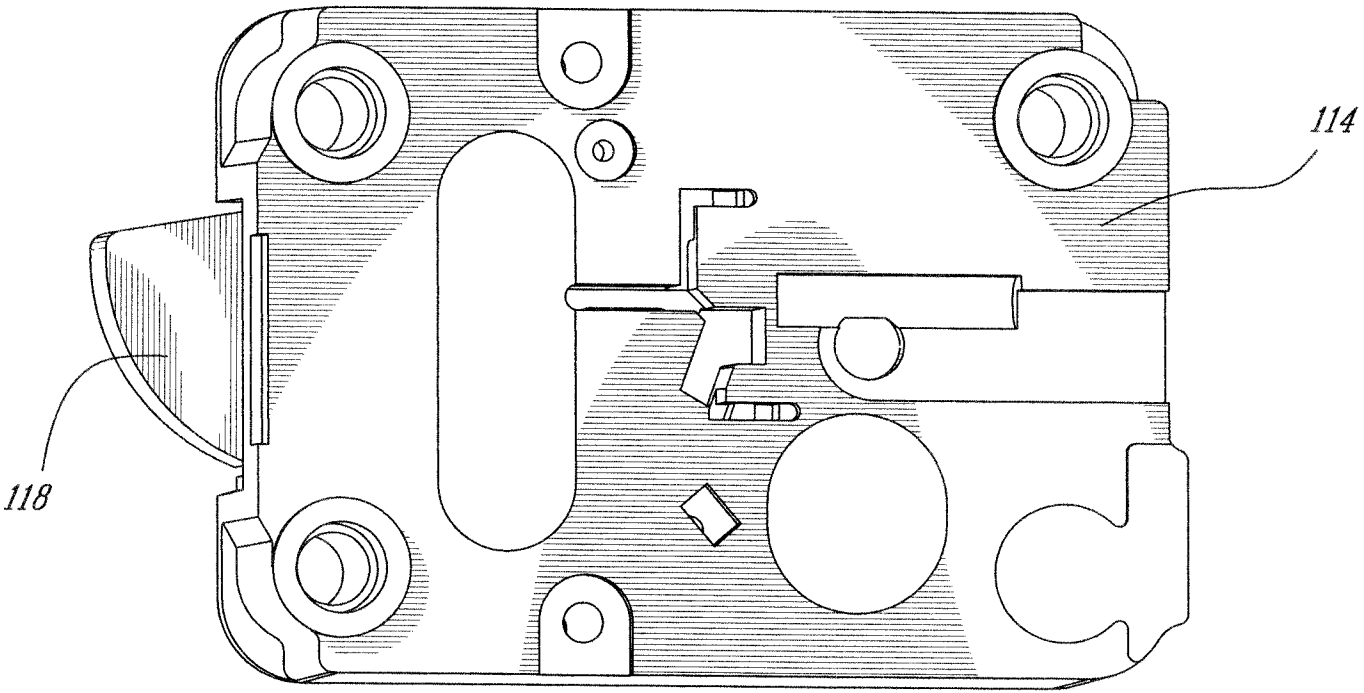
FIG. 5 is a rear view of a lock case of a swing bolt lock having a cut away section defined in the lock case to provide a deformable member adapted to block the swing bolt blocking member when the lock is subject to an attack.
Figure 6:
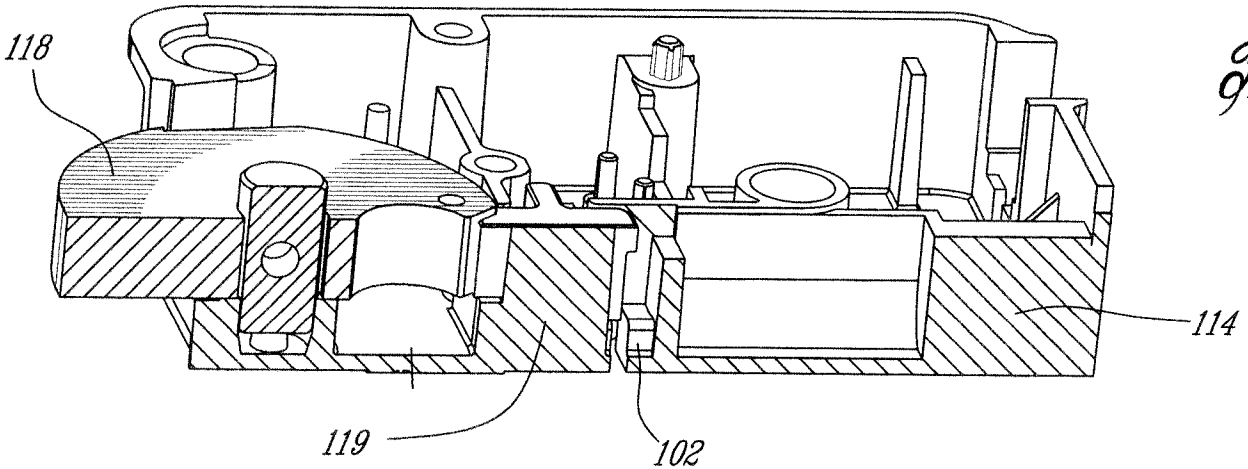
FIG. 6 is a section view of the swing bolt lock shown in FIG. 5 illustrating the lock in a locked position before the deformation of the deformable member.
Figure 7:
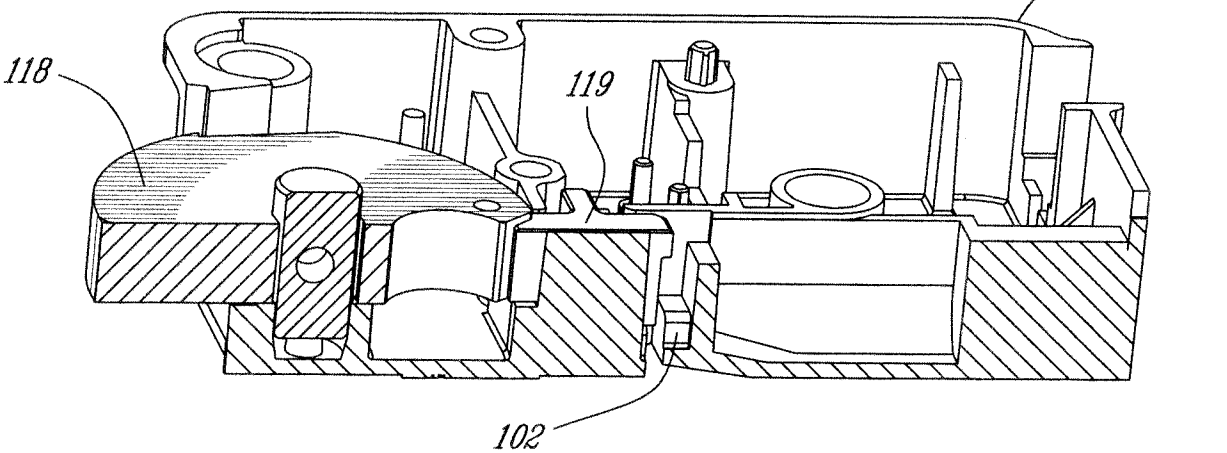
FIG. 7 is a section view of the swing bolt lock shown in FIG. 5 illustrating the lock in a locked position with the deformable member deformed to block the swing bolt blocking member, thereby preventing unlocking of the lock.

FIGS. 5 to 7 illustrate another embodiment of a swing bolt relocking mechanism. This embodiment is characterized by a first member which is provided in the form of a deformable member 102 which is adapted to deform into the path of the swing bolt blocking member 119 to prevent the blocking member 119 from moving out of the path of the swing bolt 118, thereby physically blocking movement of the swing bolt 118. As shown in FIG. 5, the deformable member 102 can be integrated into the lock case 114 by cutting away a section of the lock case 114 adjacent to the blocking member 119 in such a way as to cause a portion of the lock case 114 (i.e. the deformable member 102) to deform when the lock is attacked through the spindle hole in the door using a hammer and a punch. As shown in FIG. 6, under normal circumstances, the deformable member 102 clears the path of the blocking member 119, thereby allowing the blocking member 119 to linearly translate back and forth to selectively prevent or allow the rotation of the swing bolt 118. However, in the event of a physical attack, the deformable member 102 will under the impact forces on the case 114 bend into the path of the blocking member 119, thereby preventing withdrawal thereof. As shown in FIG. 7, once deformed, the deformable member 102 prevents the blocking member 119 from moving away from the swing bolt 118, thereby indirectly blocking the bolt 118 in its locked state. This relocking mechanism takes advantage of the already existing blocking member 119 of the lock mechanism to prevent unauthorized opening of the lock (i.e. the blocking member corresponds to the second member of the relocking mechanism).

Figure 8:
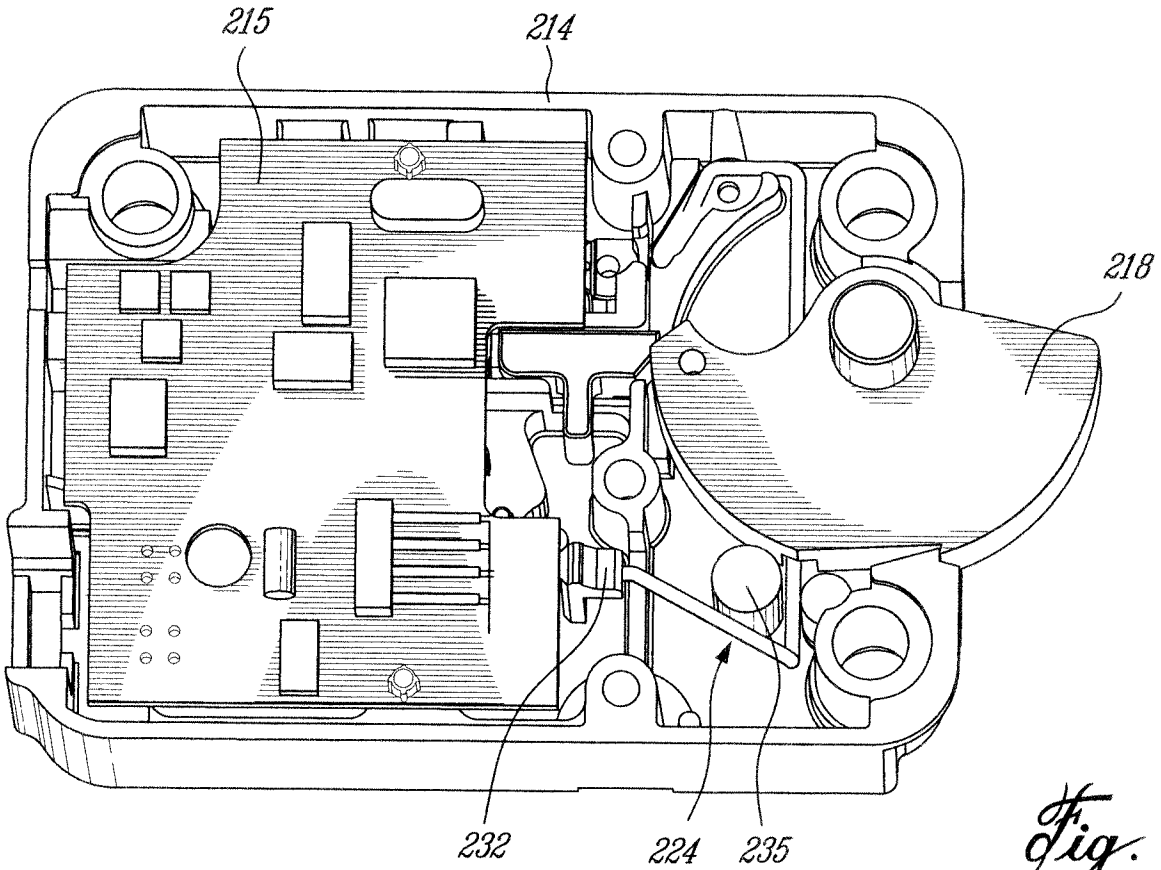
FIG. 8 is a perspective view of a swing bolt lock assembly illustrating another embodiment of a relocking mechanism comprising a fly away member and a spring-loaded wire form blocker.
Figure 9:
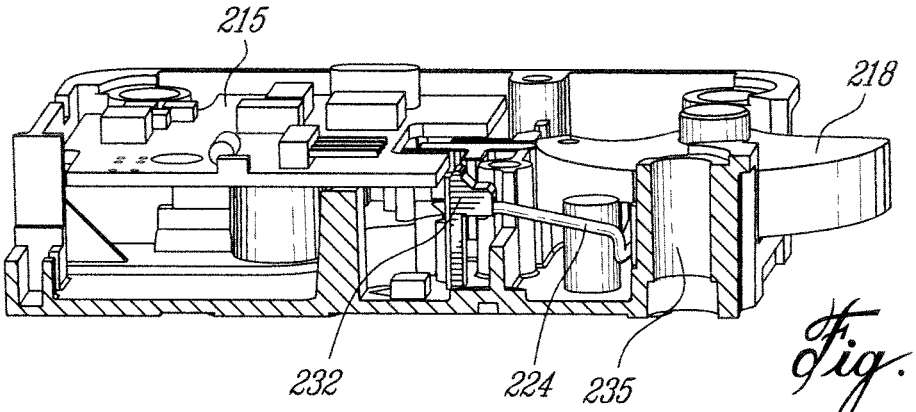
FIG. 9 is a section view of the swing bolt lock assembly shown in FIG. 8 illustrating the fly away member trapped in position between a card and the lock case.
Figure 10:
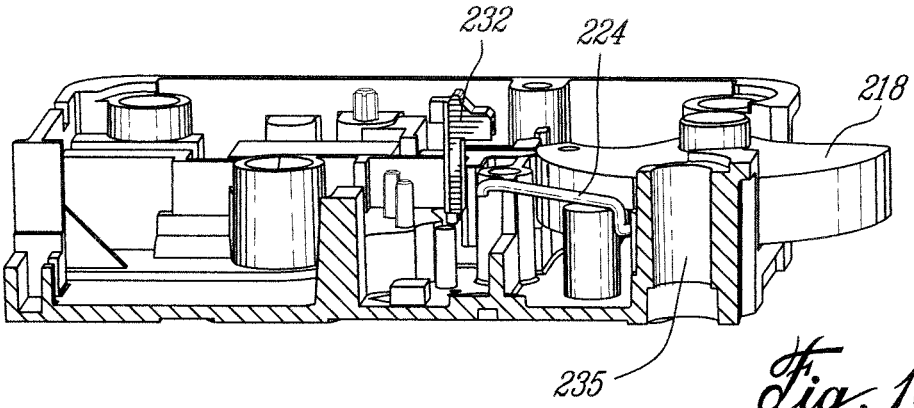
FIG. 10 is a section view of the swing bolt lock assembly shown in FIG. 8 with the fly away member released.
Figure 11:
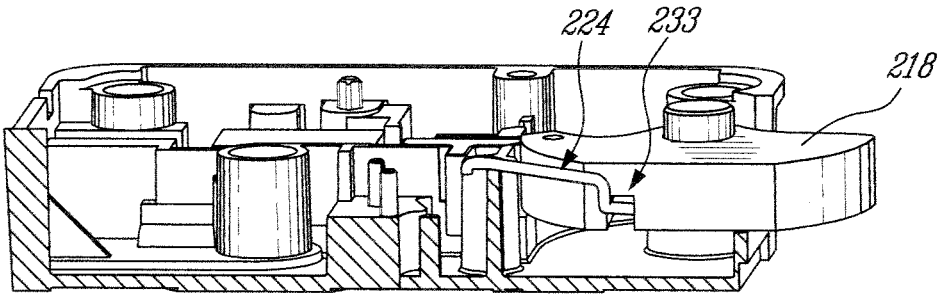
FIG. 11 is a section view of the swing bolt lock assembly shown in FIG. 10 with the spring-loaded wire form blocker released into a notch defined in the swing bolt of the lock.

FIGS. 8 to 11 illustrate a further embodiment of a relocking mechanism which is characterized by a first member which is provided in the form of a fly away member 232 which is releasably or detachably mounted inside the lock case 214 for normally holding the second member of the mechanism in this case a spring-loaded wire form blocker 224 away from the swing bolt 218 of the lock. As shown in FIGS. 8 and 9, the fly away member 232 can be trapped between the lock case 214 and a card 215 mounted to the lock case 214 with the spring-loaded wire form blocker 224 engaged there under. Alternatively, the fly away member 232 could be trapped between the lock case 214 and the lock cover (not shown). In the event of an attack, the impact forces applied on the lock case 214, cover or card 215 through the spindle hole in the door will cause the lock case 214, cover or card 215 to deform or, alternatively, the detachment of the card 215 from the case 214, thereby releasing the fly away member 232. As shown in FIGS. 10 and 11, the release of the fly away member 232 will, in turn, cause the spring-loaded wire form blocker 224 to automatically fall into a notch 233 defined in the swing bolt 218, thereby retaining the bolt 218 from rotating. A blocking bolt 235 extends from the inner face of the lock case 214 to prevent the wire form blocker 224 from being bent by the rotation of the swing bolt 218.

The above descriptions are meant to be exemplary only, and one skilled in the art will recognize that changes may be made to the embodiments described without departing from the scope of the invention herein disclosed. For example, the breakaway member could be provided in the form of a frangible member adapted to be broken away so as to release the plunger when ever a force exceeding a predetermined value is transmitted to the lock housing. Also, the breakaway member itself could be used to block the movement of the bolt instead of the above described pre-loaded plunger arrangement. For instance, the relocking mechanism could comprise a breakaway, frangible or brittle member for interlocking the bolt with the lock case by wedging itself between the lock case wall and the bolt when the lock assembly is physically or mechanically attacked through the door spindle hole with a hammer and punch. The lock cover 16 would bend along the thinned section 48 as shown in FIG. 4, thereby breaking and/or pivoting the breakaway member allowing the massive end of the breakaway member to progress into the path of the bolt, thus securing the lock in the locked state. Still other modifications which fall within the scope of the present invention will be apparent to those skilled in the art, in light of a review of this disclosure, and such modifications are intended to fall within the appended claims.

What is claimed is:

1. A swing bolt lock comprising a swing bolt mounted in a housing adapted to be mounted to a door having a spindle hole defined therethrough, the swing bolt being pivotable between a locking and an unlocking position, a blocker movably mounted in said housing towards and away from the swing bolt for selectively blocking or allowing rotation of the swing bolt during normal operation, and a relocking mechanism for automatically locking the swing bolt in a secure locked state when the lock is subject to a physical attack, the relocking mechanism comprising a first member connected in force transmission relationship to the housing such that externally-applied forces against the housing through the spindle hole of the door are transmitted to the first member, and a second member having an abutting surface for engagement with the swing bolt, the abutting surface of the second member physically blocking the swing bolt from moving to the unlocking position when the first member is moved from an initial default position to an operational position under the externally-applied forces wherein prior to a physical attack, the second member is held in a non-operational retracted position by the first member, and wherein the first member comprises a breakaway member mounted to an inner face of the housing, the breakaway member having a free distal end portion which extends in front of the second member when the breakaway member assumes its initial default position before the physical attack.

2. The swing bolt lock defined in claim 1 wherein said first member releases said second member when displaced to its operational position under the externally-applied forces.

3. The swing bolt lock defined in claim 1, wherein the housing has a first wall mounted to the door and a second wall opposite from said first wall, the inner face of the housing being provided on said second wall and having first and second regions separated by a weak section, the first region being aligned with the spindle hole of the door, the breakaway member being attached to the first region of the second wall of the housing with the free distal end portion of the breakaway member extending beyond the weak section to the second region of the inner face of the second wall of the housing, the second wall of the housing being configured to break generally along the weak section when the externally-applied forces exceed a predetermined threshold value, the breakaway member being jointly forced out of position with the first region of the second wall, thereby causing the free distal end portion of the breakaway member to move away from the second member.

4. The swing bolt lock defined in claim 3, wherein said second member is a preloaded plunger mounted in a hole defined in the second region of the second wall of the housing adjacent to the swing bolt.

5. The swing bolt lock defined in claim 4, wherein the breakaway member is a deformable metal wire form, and wherein the housing comprises a case and a cover, the cover forming the second wall of the housing.

6. The swing bolt lock defined in claim 1, wherein a biasing member urges said second member towards a swing bolt engaging position in which the abutting surface of the second member is disposed in the path of the swing bolt, the first member normally holding the second member in its retracted position against a biasing force of the biasing member.

7. The swing bolt lock defined in claim 6, wherein the second member comprises a spring-loaded plunger mounted to the housing adjacent to the swing bolt for movement in a direction generally perpendicular to the swing bolt.

8. The swing bolt lock defined in claim 1, wherein the breakaway member has a proximal end portion opposite to said free distal end portion, said proximal end portion being aligned with the spindle hole when the lock is mounted to the door to cause the breakaway member to be ripped out from the inner face of the housing under the externally-applied forces of the attack.

9. The swing bolt lock defined in claim 8, wherein the breakaway member has first and second points of attachment to the inner surface of the housing, said points of attachment being configured to be ruptured when said proximal end portion of the breakaway member receives the externally-applied forces of the attack.

10. The swing bolt lock defined in claim 8, wherein said second member comprises a pre-loaded plunger slidably mounted in a hole extending through said inner face of the housing between the blocker and the swing bolt.

11. The swing bolt lock defined in claim 1, wherein the breakaway member is a fly away member releasably mounted inside the housing for normally holding the second member away from the swing bolt, the second member comprising a spring-loaded wire form blocker adapted to fall in a notch defined in a face of the swing bolt.

12. The swing bolt lock defined in claim 11, wherein the fly away member is trapped between two internal surfaces of the lock, the internal surfaces being generally parallel to a rotary axis of the swing bolt, the spring-loaded wire form blocker being retained between the fly away member and one of said two lock inner surfaces, and wherein a blocking bolt extends from the one of said lock inner surfaces to prevent the wire form blocker from being bent by the rotation of the swing bolt.

13. The swing bolt lock defined in claim 1, wherein the second member of the relocking mechanism is the blocker used to selectively block or allow rotation of the swing bolt under normal operation, and wherein the first member deforms into the path of the blocker to prevent the blocker from moving out of the path of the swing bolt when the lock is subject to a physical attack.

14. The swing bolt lock defined in claim 13, wherein the first member is formed in a door mounting surface of the housing in general alignment with the spindle hole defined in the door to which the housing is mounted.

15. The swing bolt lock defined in claim 14, wherein the first member is cut in the door mounting surface of the housing such as to cause the first member to deform into the path of the blocker when receiving the externally applied forces of the physical attack.

16. A relocking mechanism for automatically locking a lock in a secure locked state when subject to a physical attack, the lock having a housing mounted to a door defining a spindle hole, the lock having a bolt moveable between a locking and an unlocking position; the relocking mechanism comprising: a plunger normally held in a retracted position by a breakaway member disposed to receive the force of an impact attack through the spindle hole of the door, the force of the impact attack causing the breakaway member to release the plunger which is then free to move under the action of a biasing member to an extended position in which the plunger physically blocks the movement of the bolt to the unlocking position, wherein the breakaway member comprises a bendable wire form mounted to an inner face of a cover of the housing, the metal wire form having a section thereof which is aligned with the spindle hole of the door.

17. The relocking mechanism defined in claim 16, wherein the cover has first and second sections separated by a weak region, the bendable wire form extending over both the first and second sections but being only attached to the first section, the spindle hole being aligned with said first section, whereas the bolt and the plunger are located on the second section of the cover.

18. The relocking mechanism defined in claim 16, wherein the bendable wire form has two points of attachment to the inner face of the cover, the two points of attachment being disposed such that the spindle hole in the door being substantially disposed between the two points of attachment.

19. A swing bolt lock comprising a swing bolt mounted in a housing adapted to be mounted to a door having a spindle hole defined therethrough, the swing bolt being pivotable between a locking and an unlocking position, a blocker movably mounted in said housing towards and away from the swing bolt for selectively blocking or allowing rotation of the swing bolt during normal operation, and a relocking mechanism for automatically locking the swing bolt in a secure locked state when the lock is subject to a physical attack, the relocking mechanism comprising a first member connected in force transmission relationship to the housing such that externally-applied forces against the housing through the spindle hole of the door are transmitted to the first member, and a second member having an abutting surface for engagement with the swing bolt, the abutting surface of the second member physically blocking the swing bolt from moving to the unlocking position when the first member is moved from an initial default position to an operational position under the externally-applied forces, wherein the first member is a fly away member releasably mounted inside the housing for normally holding the second member away from the swing bolt, the second member comprising a spring-loaded wire form blocker adapted to fall in a notch defined in a face of the swing bolt.

20. A swing bolt lock comprising a swing bolt mounted in a housing adapted to be mounted to a door having a spindle hole defined therethrough, the swing bolt being pivotable between a locking and an unlocking position, a blocker movably mounted in said housing towards and away from the swing bolt for selectively blocking or allowing rotation of the swing bolt during normal operation, and a relocking mechanism for automatically locking the swing bolt in a secure locked state when the lock is subject to a physical attack, the relocking mechanism comprising a first member connected in force transmission relationship to the housing such that externally-applied forces against the housing through the spindle hole of the door are transmitted to the first member, and a second member having an abutting surface for engagement with the swing bolt, the abutting surface of the second member physically blocking the swing bolt from moving to the unlocking position when the first member is moved from an initial default position to an operational position under the externally-applied forces, wherein the second member of the relocking mechanism is the blocker used to selectively block or allow rotation of the swing bolt under normal operation, and wherein the first member deforms into the path of the blocker to prevent the blocker from moving out of the path of the swing bolt when the lock is subject to a physical attack.

* * * * *